US009348275B2

(12) United States Patent
Fukunaga et al.

(10) Patent No.: US 9,348,275 B2
(45) Date of Patent: May 24, 2016

(54) FIXING DEVICE INCLUDING A SUPPORT BRACKET OF A SEPERATION PLATE WITH A SENSOR ABUTTING PORTION THAT ABUTS A TEMPERATURE SENSOR HELD BY AN ARM MEMBER TO RESTRICT A CLEARANCE DISTANCE BETWEEN THE TEMPERATURE SENSOR AND A HEATING ROTATING BODY AND IMAGE FORMING APPARATUS INCLUDING THE SAME

(71) Applicant: KYOCERA Document Solutions Inc., Osaka (JP)

(72) Inventors: Yasuyuki Fukunaga, Osaka (JP); Teruyuki Miyamoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/721,043

(22) Filed: May 26, 2015

(65) Prior Publication Data

US 2015/0346653 A1 Dec. 3, 2015

(30) Foreign Application Priority Data

May 30, 2014 (JP) ..... 2014-112638

(51) Int. Cl.
*G03G 15/20* (2006.01)

(52) U.S. Cl.
CPC ..... *G03G 15/2028* (2013.01); *G03G 15/2039* (2013.01)

(58) Field of Classification Search
CPC ..... G03G 15/2085; G03G 15/2078; G03G 15/2039; G03G 15/2028
USPC ..... 399/323
See application file for complete search history.

(56) References Cited

U.S. PATENT DOCUMENTS

| | | | | |
|---|---|---|---|---|
| 5,649,265 | A * | 7/1997 | Tabuchi | 399/44 |
| 7,962,079 | B2 * | 6/2011 | Ogata | 399/323 |
| 2003/0227533 | A1 | 12/2003 | Yokoi | |
| 2005/0084302 | A1 * | 4/2005 | Masuda | G03G 15/2028 399/322 |
| 2005/0271430 | A1 * | 12/2005 | Mizuno | G03G 15/2028 399/322 |
| 2006/0210330 | A1 * | 9/2006 | Sone et al. | 399/328 |
| 2008/0124141 | A1 | 5/2008 | Okada | |
| 2015/0212466 | A1 * | 7/2015 | Fukunaga et al. | 399/122 |

* cited by examiner

*Primary Examiner* — Billy Lactaoen
*Assistant Examiner* — Arlene Heredia Ocasio
(74) *Attorney, Agent, or Firm* — Wenderoth, Lind & Ponack, L.L.P.

(57) ABSTRACT

A fixing device includes a separation plate, an arm member, an axial member, a support bracket, and a temperature sensor. The separation plate is disposed spaced apart from a peripheral surface of a heating rotating body by a predetermined clearance distance K2. The separation plate separates a recording medium having passed through between the heating rotating body and a pressing roller from the heating rotating body. The arm member holds the temperature sensor by using one end portion thereof. The axial member extends in parallel to a rotating shaft of the heating rotating body and rotatably supports the other end portion of the arm member. The support bracket supports the separation plate. The support bracket is provided with a sensor abutting portion that abuts the temperature sensor held by the arm member to restrict a clearance distance between the temperature sensor and the heating rotating body.

5 Claims, 7 Drawing Sheets

FIXING DEVICE INCLUDING A SUPPORT BRACKET OF A SEPERATION PLATE WITH A SENSOR ABUTTING PORTION THAT ABUTS A TEMPERATURE SENSOR HELD BY AN ARM MEMBER TO RESTRICT A CLEARANCE DISTANCE BETWEEN THE TEMPERATURE SENSOR AND A HEATING ROTATING BODY AND IMAGE FORMING APPARATUS INCLUDING THE SAME

CROSS-REFERENCE TO RELATED APPLICATION

This application is based upon and claims the benefit of priority from Japanese Patent Application No. 2014-112638 filed on May 30, 2014, the entire contents of which are incorporated herein by reference.

BACKGROUND

The technology of the present disclosure relates to a fixing device and an image forming apparatus including the same.

In general, an image forming apparatus, such as a laser printer, is provided with a fixing device in order to fix a toner image, which has been transferred to a paper, to the paper. The fixing device has a heating roller and a pressing roller, and is configured to heat the toner image and fix the toner image to the paper while the paper is passing through between the both rollers.

This type of fixing device, typically, has a temperature sensor for detecting the surface temperature of the heating roller. Furthermore, on the basis of the temperature detected by the temperature sensor, the fixing device controls the surface temperature of the heating roller to a fixing temperature. As the aforementioned temperature sensor, a contact type temperature sensor contacting with the heating roller and a non-contact type temperature sensor not contacting with the heating roller have been known. Since the non-contact type temperature sensor does not contact with the surface of the heating roller, the surface of the heating roller is hardly damaged. Therefore, in recent years, there have been proposed various fixing devices provided with the non-contact type temperature sensor.

In addition, there is also a case in which an endless belt is wound around the heating roller, and a toner image is heated and is fixed to a paper while the paper is passing through between the endless belt and the pressing roller. In this case, the surface temperature of the endless belt is detected by the temperature sensor.

SUMMARY

A fixing device according to one aspect of the present disclosure includes a heating rotating body and a pressing roller, and heats a toner image and fixes the toner image to a recording medium while the recording medium is passing through between the heating rotating body and the pressing roller. The heating rotating body includes a heating roller or an endless belt wound around the heating roller.

The fixing device further includes a separation plate, an arm member, an axial member, and a support bracket. The separation plate is disposed spaced apart from a peripheral surface of the heating rotating body by a predetermined clearance distance and separates the recording medium having passed through between the heating rotating body and the pressing roller from the heating rotating body. The arm member holds a temperature sensor by using one end portion thereof. The axial member extends in parallel to a rotating shaft of the heating rotating body and rotatably supports the other end portion of the arm member. The support bracket supports the separation plate. The support bracket is provided with a sensor abutting portion. The sensor abutting portion abuts the temperature sensor held by the arm member to restrict a clearance distance between the temperature sensor and the heating rotating body to a predetermined distance.

DETAILED DESCRIPTION

Hereinafter, an embodiment will now be described in detail with reference to the drawings. The technology of the present disclosure is not limited to the following embodiments.

<<Embodiment>>

Figure 1:
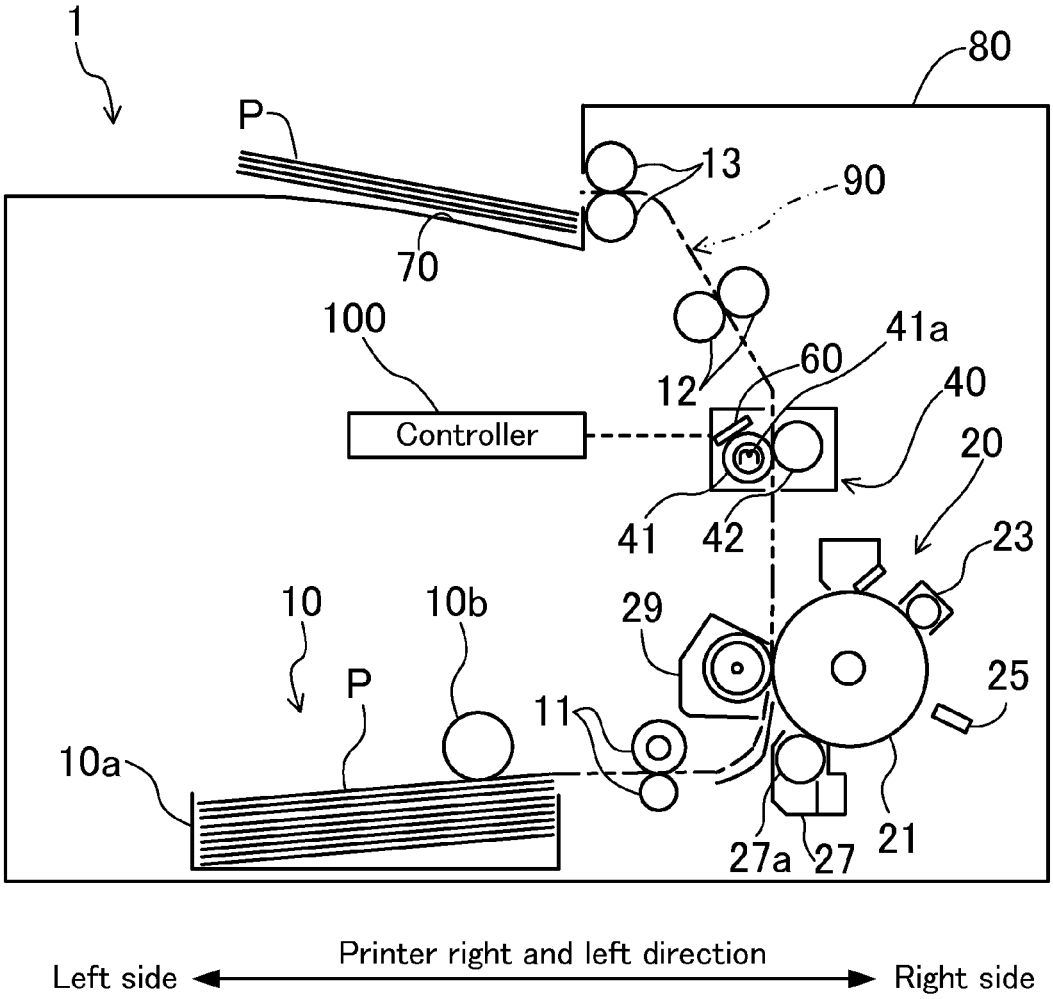
FIG. 1 is a schematic longitudinal sectional view illustrating an image forming apparatus including a fixing device in an embodiment.

FIG. 1 illustrates a laser printer 1 (hereinafter, simply referred to as a printer) including a paper conveying device in the present embodiment. The printer 1 includes an apparatus body 80 having an image forming unit 20. A paper feeding unit 10 is provided at a lower portion of the apparatus body 80, and a paper discharge unit 70 is formed on an upper surface of the apparatus body 80. At a paper conveyance path 90 from the paper feeding unit 10 to the paper discharge unit 70, a plurality of conveying roller pairs 11 to 13, which interpose a paper P as a recording medium therebetween and convey the paper P, are sequentially disposed toward a downstream side from an upstream side. In the following description, a fore side and a rear side respectively indicate a front side and a back side in a direction vertical to the paper surface of FIG. 1, and a left side and a right side respectively indicate a left side and a right side in the right and left direction of FIG. 1.

The aforementioned paper feeding unit 10 has a paper feeding cassette 10*a* in which a sheet-like paper P is accommodated, and a pick-up roller 10*b* for taking out the paper P in the paper feeding cassette 10*a* and sending the paper P out of the cassette. The paper P sent out of the paper feeding cassette 10*a* by the pick-up roller 10*b* is supplied to the image forming unit 20 via the conveying roller pair 11.

The image forming unit 20 includes a photosensitive drum 21, a charging device 23, an exposing device 25, a developing device 27, a transfer device 29, and a fixing device 40. At the time of image formation, a peripheral surface of the photosensitive drum 21 is charged by the charging device 23, and then laser light based on document image data (for example, image data of a document image received from an external terminal) is irradiated onto the surface of the photosensitive drum 21 by the exposing device 25. Accordingly, an electrostatic latent image corresponding to the aforementioned image data is formed on the surface of the photosensitive drum 21. The electrostatic latent image formed on the surface of the photosensitive drum 21 is developed by the developing device 27 as a toner image. In this way, the toner image is formed (carried) on the surface of the photosensitive drum 21. The toner image is transferred to the paper P, which has been supplied from the paper feeding unit 10, by the transfer device 29. The paper P with the transferred toner image is supplied to the fixing device 40 by the rotation of a transfer roller in the transfer device 29.

The fixing device 40 has a heating roller 41 serving as a heating rotating body and a pressing roller 42, which are disposed to face each other. The pressing roller 42 is brought into press-contact with the heating roller 41 by an urging member (not illustrated). The paper P supplied to the fixing device 40 by the transfer device 29 passes through between the heating roller 41 and the pressing roller 42. In this way, the toner image is heated and is fixed to the paper P. The paper P with the fixed toner image is sent to a downstream side by these rollers 41 and 42. The paper P sent by the fixing device 40 is discharged to the aforementioned paper discharge unit 70 by the plurality of conveying roller pairs 12 and 13.

Figure 2:
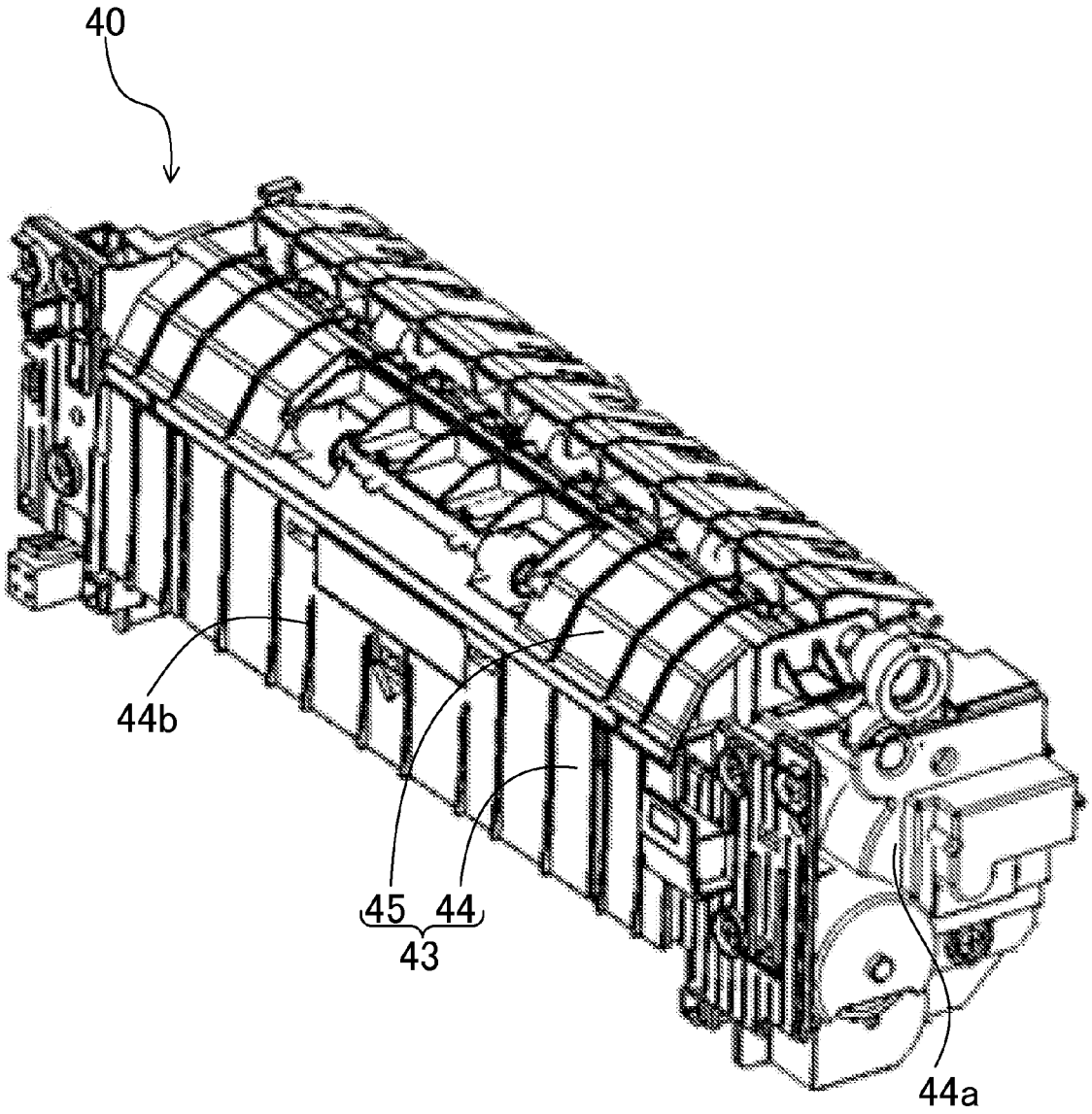
FIG. 2 is a perspective view illustrating an external appearance of a fixing device.

As illustrated in FIG. 2, the aforementioned fixing device 40 is covered by a case 43. The case 43 has a case body with an opened upper side and a lid 45 that closes the upper side of the case body 44. In the case 43, the aforementioned heating roller 41 and pressing roller 42 are accommodated.

Figure 3:
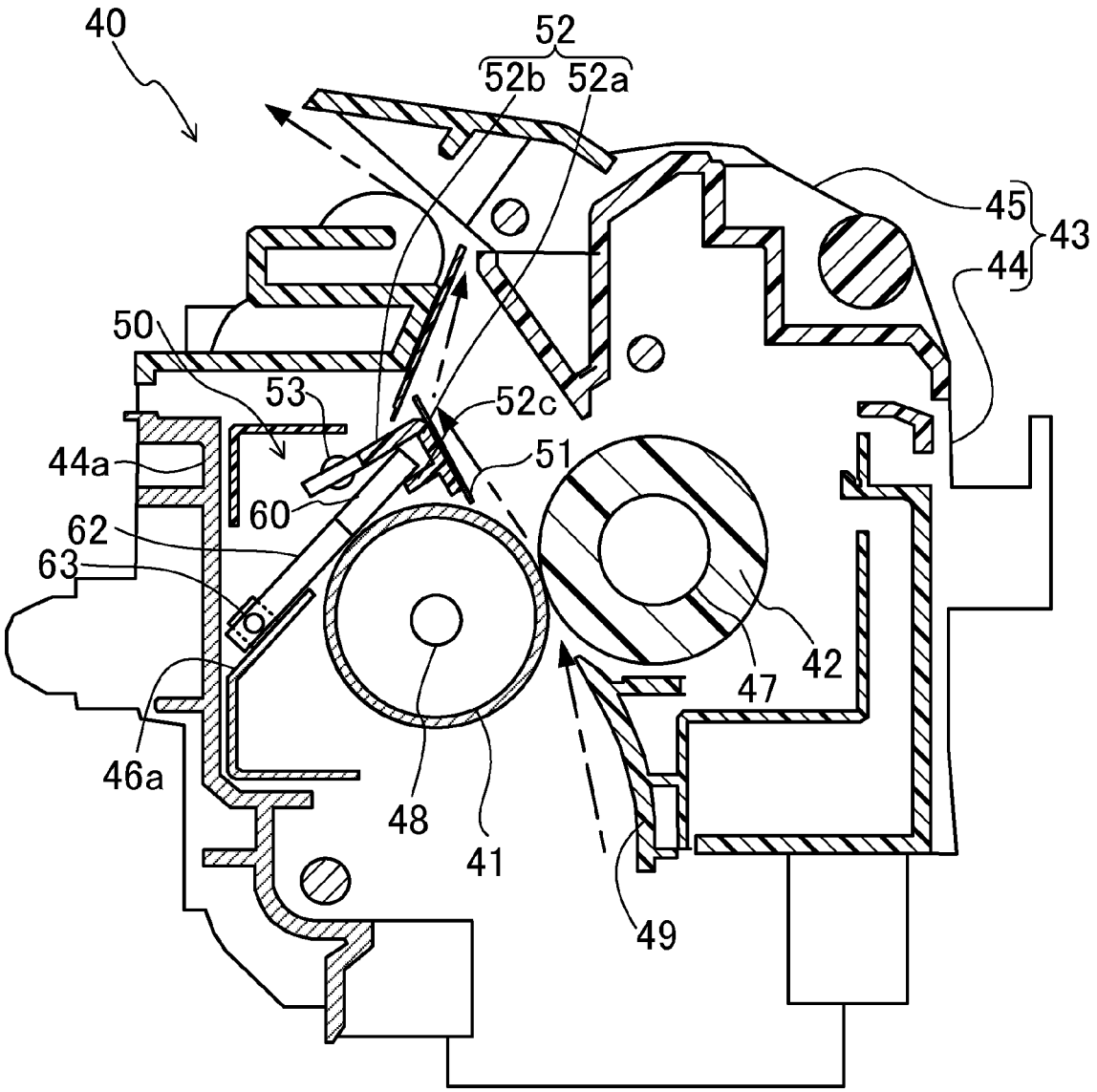
FIG. 3 is a longitudinal sectional view illustrating a fixing device.

As illustrated in FIG. 3, the heating roller 41 is fixed to a support shaft 48 passing through an axial center part thereof. The pressing roller 42 is fixed to a support shaft 47 passing through an axial center part thereof. A guide plate 49 is provided at a lower portion in the case 43. The guide plate 49 is inclined leftward toward an upper side, and leads the paper P supplied by the transfer device 29 between the heating roller 41 and the pressing roller 42.

The fixing device 40 has a separation mechanism 50 and a temperature sensor 60 in addition to the aforementioned heating roller 41 and pressing roller 42. The separation mechanism 50 has a function of separating the paper P having passed through between the heating roller 41 and the pressing roller 42 from the heating roller 41. In detail, the separation mechanism 50 has a separation plate 51, a support bracket 52, and a support pin (corresponding to an axial member) 53. The separation plate 51 is made of rectangular plate material. The separation plate 51 extends in parallel to a rotating shaft of the heating roller 41. The separation plate 51 is disposed spaced apart from the peripheral surface of the heating roller 41 by a predetermined clearance distance K1 (for example, about 0.3 mm) (see FIG. 5). The surface of the separation plate 51 has been subjected to fluorine coating. In this way, toner is prevented from adhering to the separation plate 51 and the paper P is easily separated.

The separation plate 51 is fixed to the support bracket 52 having an approximately L section. The support bracket 52 extends in parallel to the rotating shaft of the heating roller 41 similarly to the separation plate 51. The support bracket 52 has a fixed plate portion 52*a* to which the separation plate 51 has been fixed, and a vertical plate portion 52*b* vertically connected to the fixed plate portion 52*a*. The positioning of the separation plate 51 with respect to the support bracket 52 is performed using a jig and the like in an assembly process. The separation plate 51 is fixed to the fixed plate portion 52*a* of the support bracket 52 by spot welding. A sensor abutting portion 52*c* protrudes from a surface opposite to a side of the fixed plate portion 52*a* to which the separation plate 51 is fixed. The sensor abutting portion 52*c* abuts the temperature sensor 60 to restrict a clearance distance K2 between the temperature sensor 60 and the heating roller 41 to a predetermined distance (for example, 1 mm). The sensor abutting portion 52*c* has a plate shape extending in the direction of the rotating shaft of the heating roller 41. However, the sensor abutting portion 52*c* does not always need to have the plate shape, and for example, may have a cylindrical protrusion shape or a prismatic protrusion shape.

An end portion of a side of the vertical plate portion 52*b*, which is opposite to the fixed plate portion 52*a* side, is rotatably supported to the support pin 53. Furthermore, the support bracket 52 is rotatable around the support pin 53. The support bracket 52 is urged to a clockwise direction (that is, a side close to the heating roller 41) of FIG. 3 by a twist spring 64 serving as an urging member by employing the support pin 53 as a support point.

Figure 4:
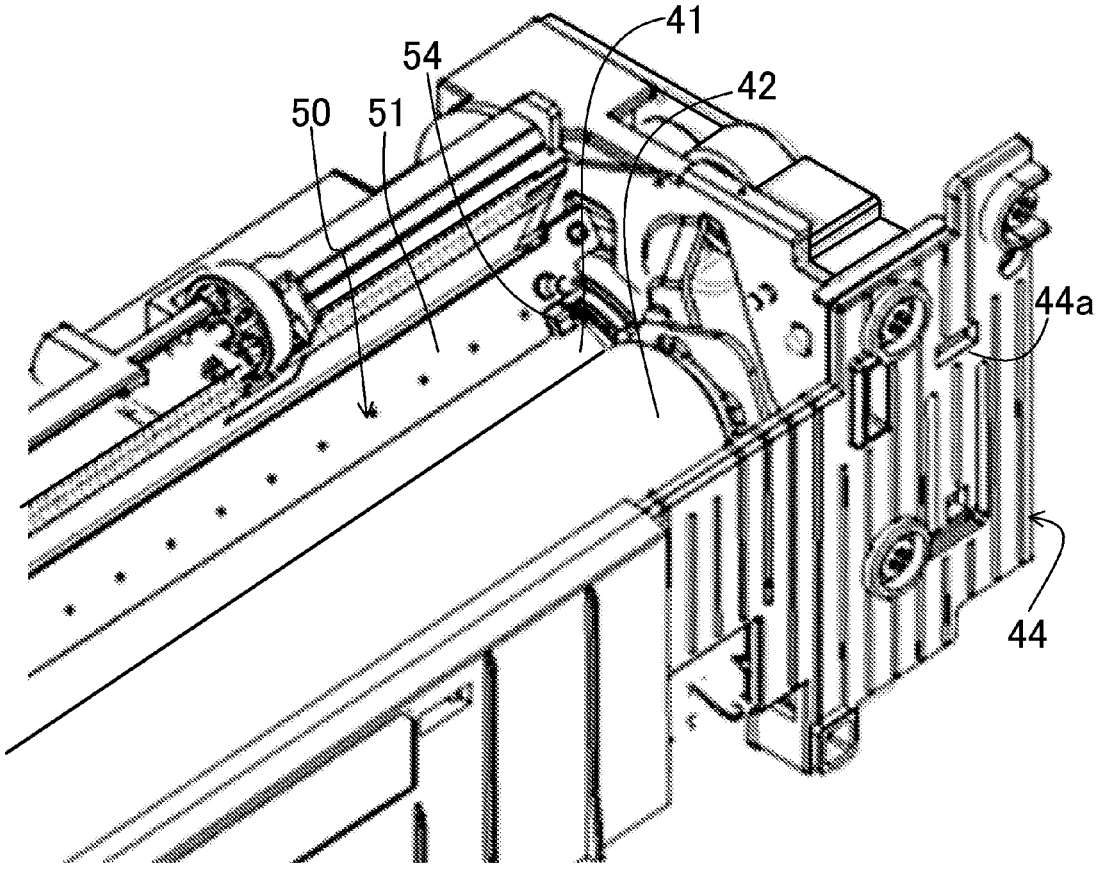
FIG. 4 is a perspective view illustrating the state in which a lid of a fixing device has been removed.
Figure 5:
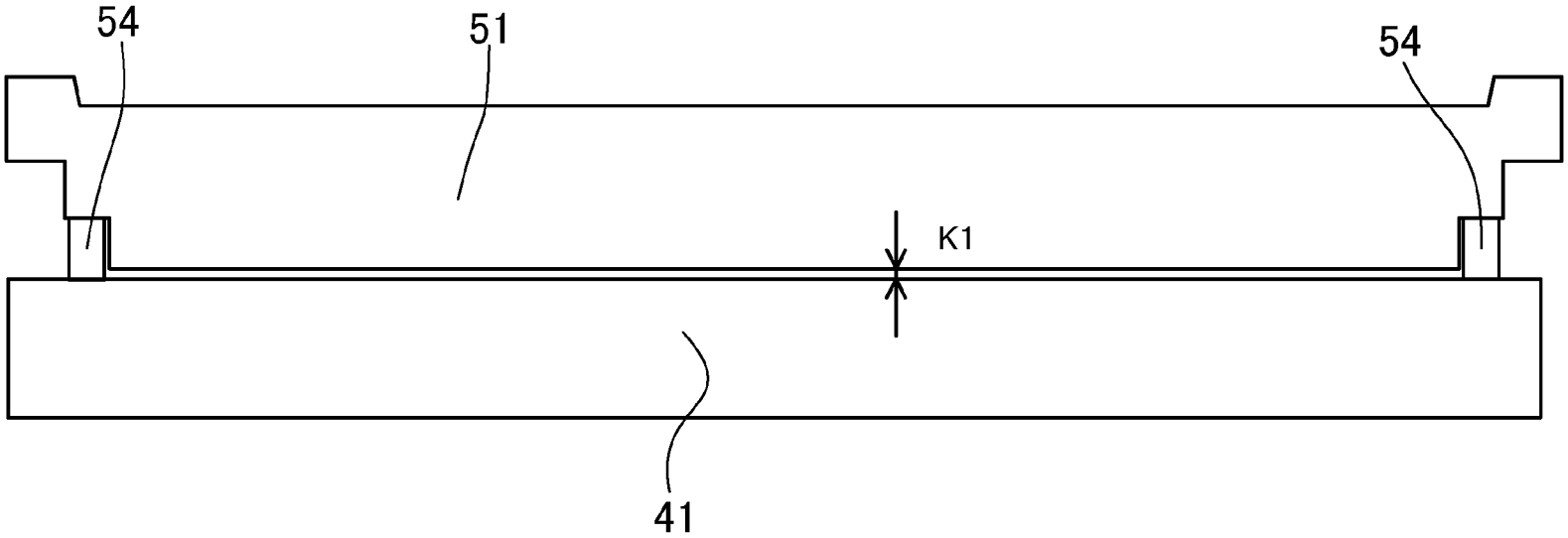
FIG. 5 is a schematic view illustrating a positioning structure of a separation plate with respect to a heating roller.

As illustrated in FIG. 4 and FIG. 5, spacers 54 having a rectangular pillar shape are provided between both end portions of the aforementioned separation plate 51 in an extension direction and the peripheral surface of the heating roller 41. The spacer 54, for example, is made of resin material. Since the separation plate 51 is urged to the side close to the heating roller 41 together with the support bracket 52, the separation plate 51 is pushed to the heating roller 41 side while interposing the spacers 54 between the separation plate 51 and the heating roller 41. Furthermore, the clearance distance K1 (see FIG. 5) between the separation plate 51 and the peripheral surface of the heating roller 41 is restricted (decided) by the spacers 54.

The aforementioned temperature sensor 60 is a sensor for measuring the temperature of the heating roller 41. The heating roller 41 has a halogen heater 41*a* (hereinafter, simply referred to as a heater) therein. The heater 41*a* and the temperature sensor 60 are electrically connected to a controller 100 (see FIG. 1). The controller 100 controls the heater 41*a* on the basis of a signal received by the temperature sensor 60, thereby controlling the temperature of the heating roller 41 to a target temperature.

Figure 6:
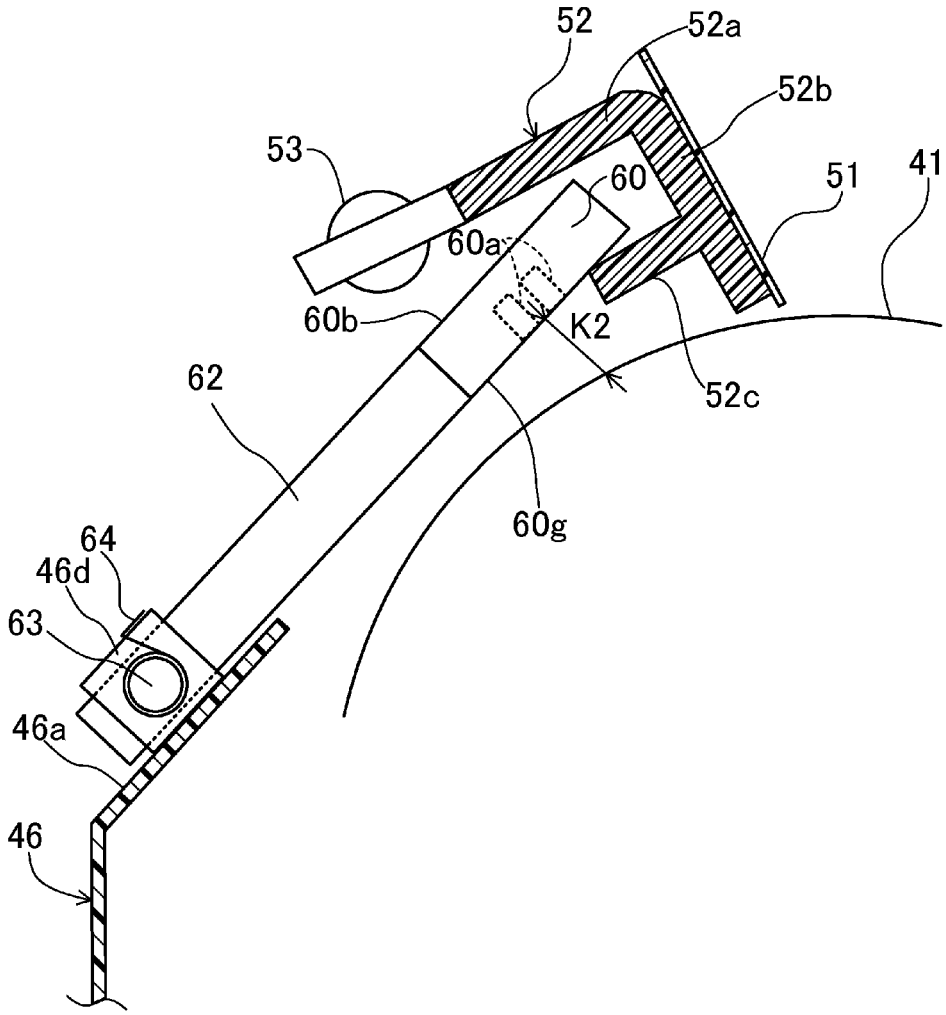
FIG. 6 is an enlarged sectional view enlarging the vicinity of a temperature sensor.

As illustrated in FIG. 6, the temperature sensor 60 is coupled to an arm member 62. The arm member 62 is inclined at an obliquely upper right position by about 45° in a horizontal direction. One end portion of the arm member 62 is rotatably supported to a support pin 63 parallel to the heating roller 41. The aforementioned temperature sensor 60 is coupled to the other end portion of the arm member 62. Both end portions of the support pin 63 are fixed to a pair of support plates 46*d*. The pair of support plates 46*d* are disposed to face each other. The pair of support plates 46*d* are formed by cutting and raising a part of an inclined plate portion 46*a* of a frame 46 made of a sheet metal. The frame 46 extends in parallel to the heating roller 41. The frame 46 is integrally formed with a sheet metal plate (not illustrated) pivotally supported to the support shaft 48 of the heating roller 41.

The temperature sensor 60 is a non-contact type temperature sensor 60, and has a pair of thermistors 60*a* and a sensor case 60*b* having an approximately rectangular parallelepiped shape, which accommodates the pair of thermistors 60*a*. A temperature sensitive portion of the thermistor 60*a* is exposed to an exterior by a side wall portion 60*g* of the heating roller 41 side of the sensor case 60*b*. The side wall portion 60*g* of the sensor case 60*b* abuts the sensor abutting portion 52*c* of the support bracket 52.

As described above, in the aforementioned embodiment, the temperature sensor 60 is coupled to the other end portion of the arm member 62 having one end portion pivotally supported to the support pin 63, and the sensor abutting portion 52*c* abutted by the temperature sensor 60 is formed at the support bracket 52 that supports the separation plate 51.

According to the aforementioned configuration, only by rotating the arm member 62 around the support pin 63 and only by abutting the temperature sensor 60 held by the arm member 62 to the sensor abutting portion 52*c* of the support bracket 52, it is possible to restrict the clearance distance K2 between the temperature sensor 60 and the heating roller 41 to a predetermined distance. Thus, in an assembly process, it is not necessary to adjust the clearance distance K2 between the temperature sensor 60 and the heating roller 41 by a spacer and the like. Thus, it is possible to easily perform clearance adjustment between the temperature sensor 60 and the heating roller 41.

Furthermore, in the aforementioned embodiment, as the temperature sensor 60, a thermistor type temperature sensor is configured to be used. Consequently, it is possible to reduce costs as compared with the case of using an infrared type temperature sensor 60. In the case of using the thermistor type temperature sensor 60, demands for clearance accuracy between the temperature sensor 60 and the heating roller 41 become strict as compared with the infrared type temperature sensor 60, but such demands can be easily satisfied according to the aforementioned configuration.

In the aforementioned embodiment, the spacers 54 are provided between both end portions of the separation plate 51 in the extension direction and the heating roller 41. Furthermore, the clearance distance K1 between the separation plate 51 and the heating roller 41 is decided by the spacers 54.

According to the aforementioned configuration, it is possible to improve the positional accuracy of the separation plate 51 with respect to the heating roller 41. Moreover, it is possible to improve the positional accuracy of the support bracket 52, which supports the separation plate 51, with respect to the heating roller 41. Furthermore, the positioning of the temperature sensor 60 is performed using the sensor abutting portion 52*c* formed in the support bracket 52 disposed with high positional accuracy, so that it is possible to further enhance the clearance accuracy between the temperature sensor 60 and the heating roller 41.

In the aforementioned embodiment, the arm member 62 is urged to a side, at which the temperature sensor 60 approaches the heating roller 41, by the twist spring 64.

According to the aforementioned configuration, the temperature sensor 60 can be firmly pushed to the sensor abutting portion 52*c*. Consequently, no floating occurs between the temperature sensor 60 and the sensor abutting portion 52*c*. Thus, it is possible to enhance the clearance accuracy between the temperature sensor 60 and the heating roller 41 as much as possible.

Furthermore, since the aforementioned printer 1 is provided with the aforementioned fixing device 40, it is possible to accurately detect the surface temperature of the heating roller 41 by the temperature sensor 60. Moreover, it is possible to accurately perform the temperature control of the heating roller 41 by the controller 100. Thus, it is possible to improve the quality of an image formed by the printer 1.

<<Other Embodiments>>

The technology of the present disclosure may also have the following configurations.

Figure 7:
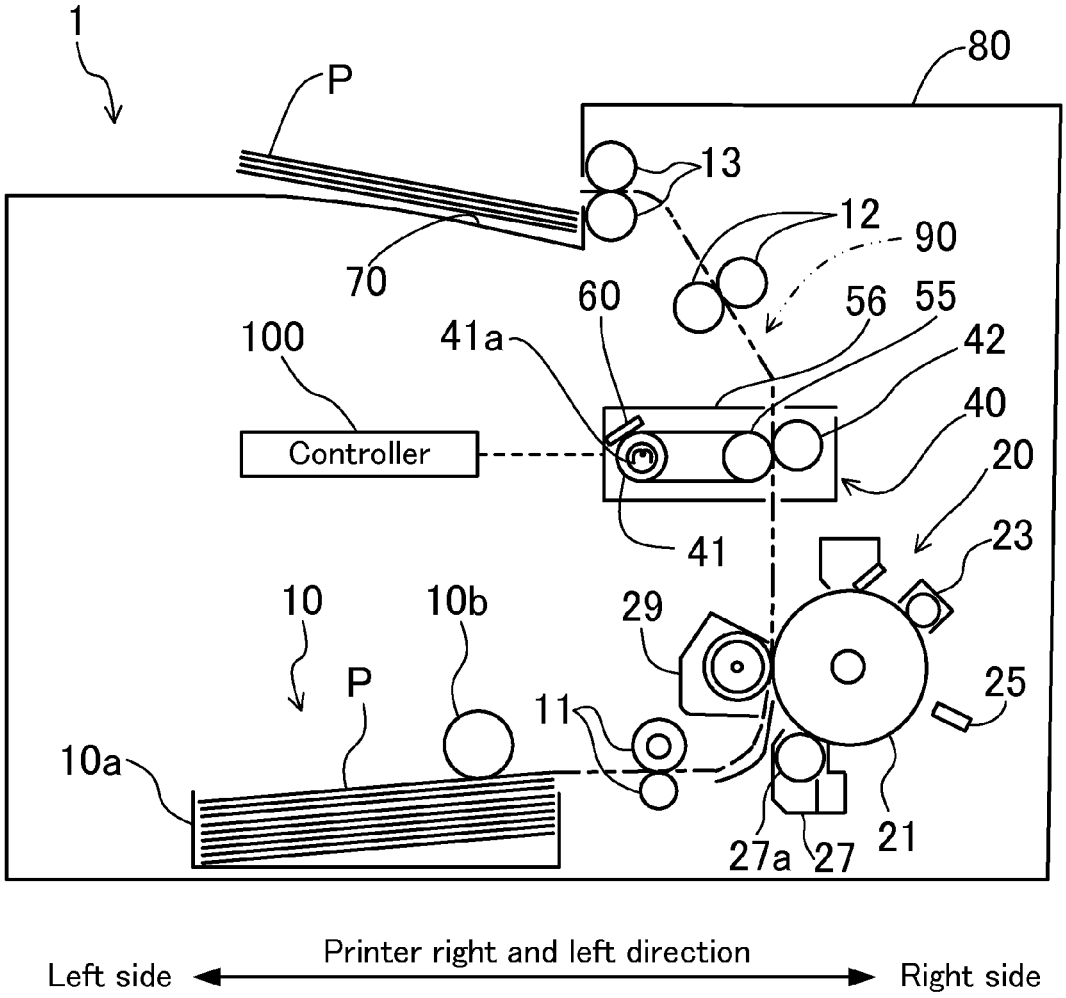
FIG. 7 is a longitudinal sectional view illustrating a fixing device in another embodiment.

That is, in the aforementioned embodiment, the pressing roller 42 is configured to be brought into press-contact with the heating roller 41; however, the present invention is not limited thereto. For example, as illustrated in FIG. 7, the pressing roller 42 may also be brought into press-contact with an endless belt 56 heated by the heating roller 41. In this fixing device, a rotating roller 55 is disposed to face the pressing roller 42, and the endless belt 56 (a heating rotating body) is wound around the rotating roller 55 and the heating roller 41. The endless belt 56 rotates with the rotation of the rotating roller 55 and the heating roller 41. Furthermore, while the paper P is passing through between the pressing roller 42 and the endless belt 56, a toner image is heated and is fixed to the paper P. The temperature sensor 60 is disposed spaced apart from the endless belt 56 by a predetermined clearance. It is sufficient if a positioning mechanism of the temperature sensor 60 employs a configuration similar to that of the aforementioned embodiment.

In the aforementioned embodiment, as the temperature sensor 60, a thermistor type temperature sensor is configured to be used; however, the present invention is not limited thereto. For example, an infrared type temperature sensor may also be used. That is, the temperature sensor 60 may use any sensor as long as the sensor is non-contact type temperature sensors.

In the aforementioned embodiment, the paper P is exemplified as one example of a recording medium; however, the present invention is not limited thereto. The recording medium, for example, may be an OHP sheet and the like.

So far, as described above, the technology of the present disclosure is useful in a fixing device an image forming apparatus including the same.

What is claimed is:

1. A fixing device comprising:

a heating rotating body including (i) a heating roller or (2) a heating roller and an endless belt wound around the heating roller;

a pressing roller that rotates while being brought into press-contact with the heating rotating body, a toner image being heated and being fixed to a recording medium while the recording medium is passing between the heating rotating body and the pressing roller;

a non-contact type temperature sensor for measuring temperature of the heating rotating body;

a separation plate disposed spaced apart from a peripheral surface of the heating rotating body by a predetermined clearance distance and separating the recording medium having passed between the heating rotating body and the pressing roller from the heating rotating body;

an arm member that holds the temperature sensor by using one end portion thereof;

an axial member that extends in parallel to a rotating shaft of the heating rotating body and rotatably supports a remaining end portion of the arm member;

a support bracket that supports the separation plate; and an urging member that urges the arm member to a side at which the temperature sensor held by the one end portion of the arm member approaches the heating rotating body, wherein the support bracket is provided with a sensor abutting portion that abuts the temperature sensor held by the arm member to restrict a clearance distance between the temperature sensor and the heating rotating body to a predetermined distance, and the sensor abutting portion protrudes from a surface opposite to a side of the support bracket to which the separation plate is fixed.

2. The fixing device of claim 1, wherein the separation plate extends in parallel to the rotating shaft of the heating rotating body, and the fixing device further comprises:

a spacer provided between each end portion of the separation plate in an extension direction of the separation plate and the heating rotating body, the spacers setting a clearance distance between the separation plate and a peripheral surface of the heating rotating body.

3. An image forming apparatus comprising the fixing device of claim 1.

4. The image forming apparatus of claim 2, wherein the support bracket extends in parallel to the rotating shaft of the pressing roller, and has a fixed plate portion to which the separation plate is fixed, and a vertical plate portion vertically connected to the fixed plate portion, an end portion of a side of the vertical plate portion, which is opposite to the fixed plate portion side, is rotatably supported by a support pin, and the urging member is configured to urge the support bracket to a side close to the pressing roller by employing the support pin as a support point.

5. The image forming apparatus of claim 4, wherein the sensor abutting portion has a plate shape member extending in a rotating shaft direction of the pressing roller.

* * * * *